US009777975B2

(12) United States Patent
Folkestad, II et al.

(10) Patent No.: US 9,777,975 B2
(45) Date of Patent: Oct. 3, 2017

(54) SEMIAUTOMATIC FIREARM

(71) Applicant: CreativeArms, LLC, Des Moines, IA (US)

(72) Inventors: Robert Folkestad, II, Des Moines, IA (US); Daniel Welch, Des Moines, IA (US); Michael Six, Norwalk, IA (US); Joel Fleming, Grimes, IA (US)

(73) Assignee: CREATIVEARMS, LLC, Des Moines, IA (US)

( * ) Notice: Subject to any disclaimer, the term of this patent is extended or adjusted under 35 U.S.C. 154(b) by 139 days.

(21) Appl. No.: 14/735,402

(22) Filed: Jun. 10, 2015

(65) Prior Publication Data

US 2016/0033218 A1 Feb. 4, 2016

Related U.S. Application Data

(60) Provisional application No. 62/010,158, filed on Jun. 10, 2014.

(51) Int. Cl.

| | |
|---|---|
| ***F41A 21/00*** | (2006.01) |
| ***F41A 3/66*** | (2006.01) |
| ***F41A 5/24*** | (2006.01) |
| ***F41C 23/16*** | (2006.01) |
| ***F41A 5/28*** | (2006.01) |
| ***F41A 11/00*** | (2006.01) |

(52) U.S. Cl.

CPC *F41A 3/66* (2013.01); *F41A 5/24* (2013.01); *F41A 5/28* (2013.01); *F41A 11/00* (2013.01); *F41C 23/16* (2013.01)

(58) Field of Classification Search

USPC ..... 42/75.02, 46, 25, 14

See application file for complete search history.

(56) References Cited

U.S. PATENT DOCUMENTS

| | | | | |
|---|---|---|---|---|
| 4,440,062 A * | 4/1984 | McQueen | F41A 15/14 | 89/128 |
| 8,484,877 B2 * | 7/2013 | Zimmerman | B21C 23/14 | 42/16 |
| 2012/0216439 A1 * | 8/2012 | Barrett | F41A 3/26 | 42/75.02 |

* cited by examiner

*Primary Examiner* — J. Woodrow Eldred

(74) *Attorney, Agent, or Firm* — Christopher A. Proskey; BrownWinick Law Firm

(57) ABSTRACT

A semiautomatic firearm is presented that is a combination of known parts from the AR-15 style firearms and AK-47 style firearms and new parts. The firearm includes a receiver and a removable trunnion inserted into the receiver. A barrel is threaded and pinned into the trunnion and an adjustable gas block is connected to the barrel. The gas block includes a gas bore and an adjustable member that extends into and out of the gas bore thereby adjusting the amount of gases that travel through the gas block. The firearm also includes a foregrip installed over the barrel and gas block. The foregrip has a pattern of venting openings therein and an opening that provides access to the adjustable member of the gas block as well as a top rail and a bottom rail. The combination of these components provides a semiautomatic firearm that operates smoothly while being rugged and durable.

5 Claims, 17 Drawing Sheets

SEMIAUTOMATIC FIREARM

CROSS REFERENCE TO RELATED APPLICATION

This application claims the benefit of U.S. Provisional Application No. 62/010,158 filed Jun. 10, 2014.

FIELD OF THE INVENTION

This invention relates to firearms. More specifically, this invention relates to semiautomatic firearms.

BACKGROUND OF THE INVENTION

Since the development of gunpowder, countless types of firearms have been developed. First, muzzle loading firearms were developed, which required separate insertion of the propellant and projectile. Next, in association with the development of cartridges, breach action firearms were developed which substantially improved the speed at which a firearm could be reloaded. Breach action firearms were followed by various kinds of more sophisticated action designs, such as bolt actions, pump actions, lever actions and the like, all of which provided their own advantages, including the ease and speed of reloading. However, all of these firearm designs required the shooter to make a volitional act to reload the firearm after dispensing each round, which slowed the speed at which the firearm could be discharged.

With still further improvements in technology and manufacturing, semiautomatic and automatic firearms were developed (hereinafter "semiautomatic" firearms). Common features of semiautomatic firearms include a spring loaded action that utilizes a portion of the force of the exploding gunpowder to expel the spent cartridge and load a new cartridge. This arrangement eliminated the need for the shooter to make a volitional act to load the next cartridge. This improved the speed and ease of reloading the firearm and making follow-up shots.

Two of the most well-known semiautomatic firearms ever developed are known as the M-16, M-4 or AR-15 firearm (hereinafter the "AR-15 style firearm"), and the AK-47, MAK-90 or Kalashnikov (hereinafter the "AK-47 style firearm").

The AR-15 was originally developed in the U.S. by ArmaLite and was adopted as the small arm of choice for the United States military. The AR-15 style firearm first saw use in a large scale armed conflict in Vietnam. The AR-15 utilizes a small caliber bullet that travels at a high velocity (the AR-15 utilizes the 223/556 cartridge) and is known for its refined design, precision manufacturing, sleek componentry and smooth operation. This made for a gun that was easy to use and extremely accurate. However, the AR-15 also suffered from various deficiencies as well. Namely, it was found in Vietnam that the AR-15 was prone to jamming in the field when mud, dirt, sand, gunpowder residue or other contaminants found their way into the action. This was caused, in part, by the refined design of the firearm and the close manufacturing tolerances between the components.

In contrast, the AK-47 was originally developed in Russia and was adopted as the small arm of choice for the Russian and Chinese militaries. The AK-47 has seen use in various armed conflicts around the world, including Vietnam. The AK-47 utilizes a large caliber bullet that travels at a lower velocity as compared to the AR-15 (the AK-47 utilizes the 7.62×39 cartridge) and is known for its rugged design, extreme durability and an ability to function in the worst of conditions, which is due in part to the design which allows for wide tolerances between components of the action. While this provided for a dependable firearm on the battlefield, the AK-47 suffered from its own disadvantages. Namely, the operation of the action is crude, the firearm lacks the needed accuracy for many applications and the intentionally rough and rugged design is undesirable for many users.

From these comparisons, it can be seen that both the AR-15 and the AK-47 have their own advantages and their own disadvantages. Each firearm design is particularly well suited for some applications and particularly poorly suited for other applications. Therefore, there is a need in the art for a firearm that combines the advantages of each of these firearms while overcoming the disadvantages.

For the reasons stated above, and for other reasons stated below which will become apparent to those skilled in the art upon reading and understanding the specification, there is a need in the art for an improved semiautomatic firearm.

Thus, it is a primary object of the invention to provide an improved semiautomatic firearm that improves upon the state of the art.

Another object of the invention is to provide an improved semiautomatic firearm that combines the ruggedness of the AK-47 with the refined componentry and operation of the AR-15.

Yet, another object of the invention is to provide an improved semiautomatic firearm that is inexpensive to manufacture.

Another object of the invention is to provide an improved semiautomatic firearm that can easily be modified.

Yet, another object of the invention is to provide an improved semiautomatic firearm that is accurate.

Another object of the invention is to provide an improved semiautomatic firearm that is durable.

Yet, another object of the invention is to provide an improved semiautomatic firearm that that has a refined look and feel and operation.

Another object of the invention is to provide an improved semiautomatic firearm that is lightweight.

Yet, another object of the invention is to provide an improved semiautomatic firearm that can be easily disassembled and reassembled.

Another object of the invention is to provide an improved semiautomatic firearm that allows for easy removal and replacement of components.

Yet, another object of the invention is to provide an improved semiautomatic firearm that provides adjustable operation.

Another object of the invention is to provide an improved semiautomatic firearm that reduces or eliminates the "trigger slap" commonly found in AK-47 style firearms.

Yet, another object of the invention is to provide an improved semiautomatic firearm that is easy to use and familiar to those with knowledge and experience in the industry.

Another object of the invention is to provide an improved semiautomatic firearm that has a long useful life.

Yet, another object of the invention is to provide an improved semiautomatic firearm that provides improved comfort and safety.

Another object of the invention is to provide an improved semiautomatic firearm that adopts many of the conventional components of the AR-15 and AK-47 firearms while utilizing new and improved components when and where applicable.

These and other objects, features, or advantages of the invention will become apparent from the specification and claims.

SUMMARY OF THE INVENTION

A semiautomatic firearm is presented that is a combination of known parts from the AR-15 style firearms and AK-47 style firearms and new parts. The firearm includes a receiver and a removable trunnion inserted into the receiver. A barrel is threaded and pinned into the trunnion and an adjustable gas block is connected to the barrel. The gas block includes a gas bore and an adjustable member that extends into and out of the gas bore thereby adjusting the amount of gasses that travel through the gas block. The firearm also includes a foregrip installed over the barrel and gas block. The foregrip has a pattern of venting openings therein and an opening that provides access to the adjustable member of the gas block as well as a top rail and a bottom rail. The combination of these components provides a semiautomatic firearm that operates smoothly while being rugged and durable.

DETAILED DESCRIPTION

Figure 1:
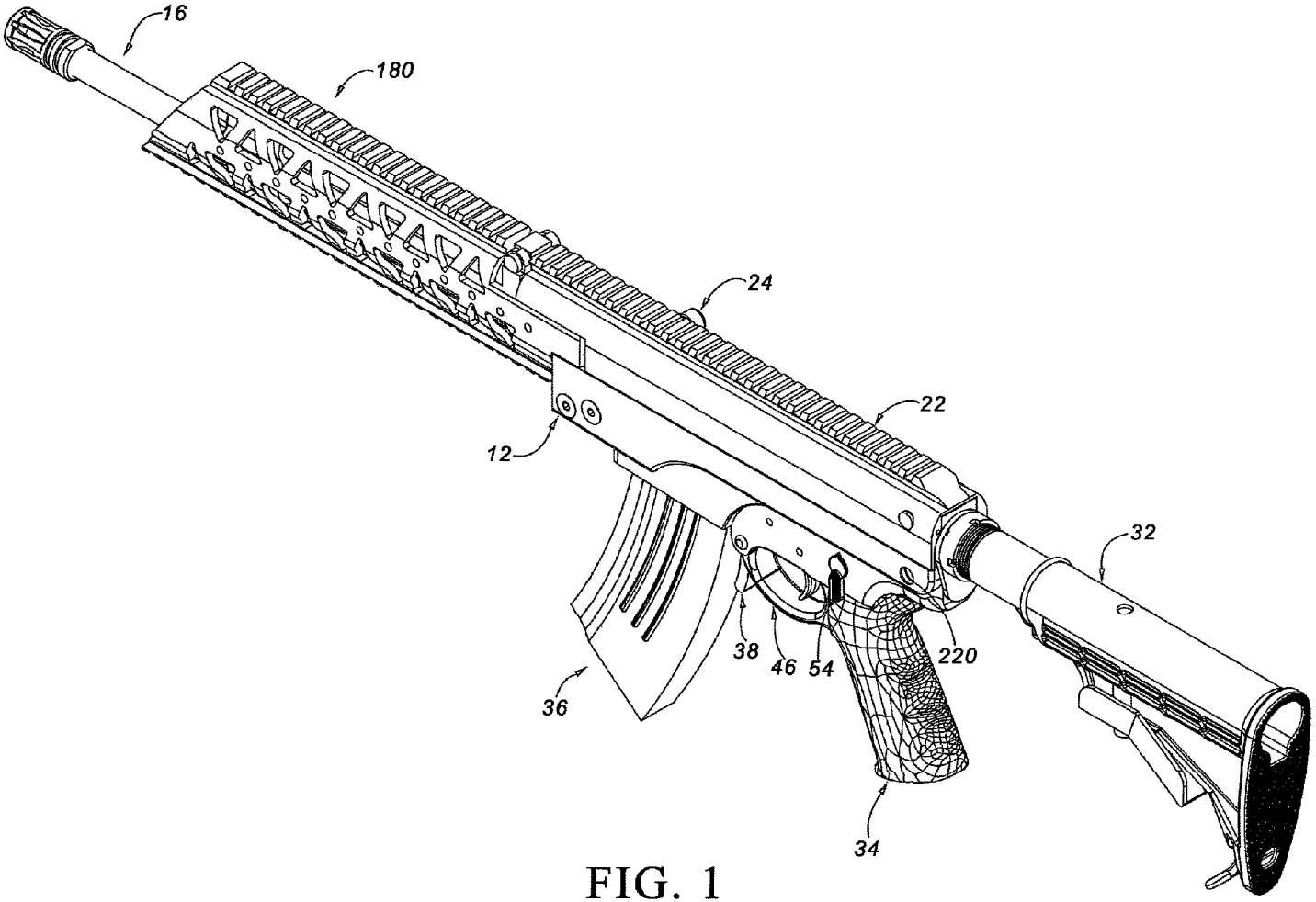
FIG. 1 is a side perspective view of an improved semiautomatic firearm.
Figure 2:
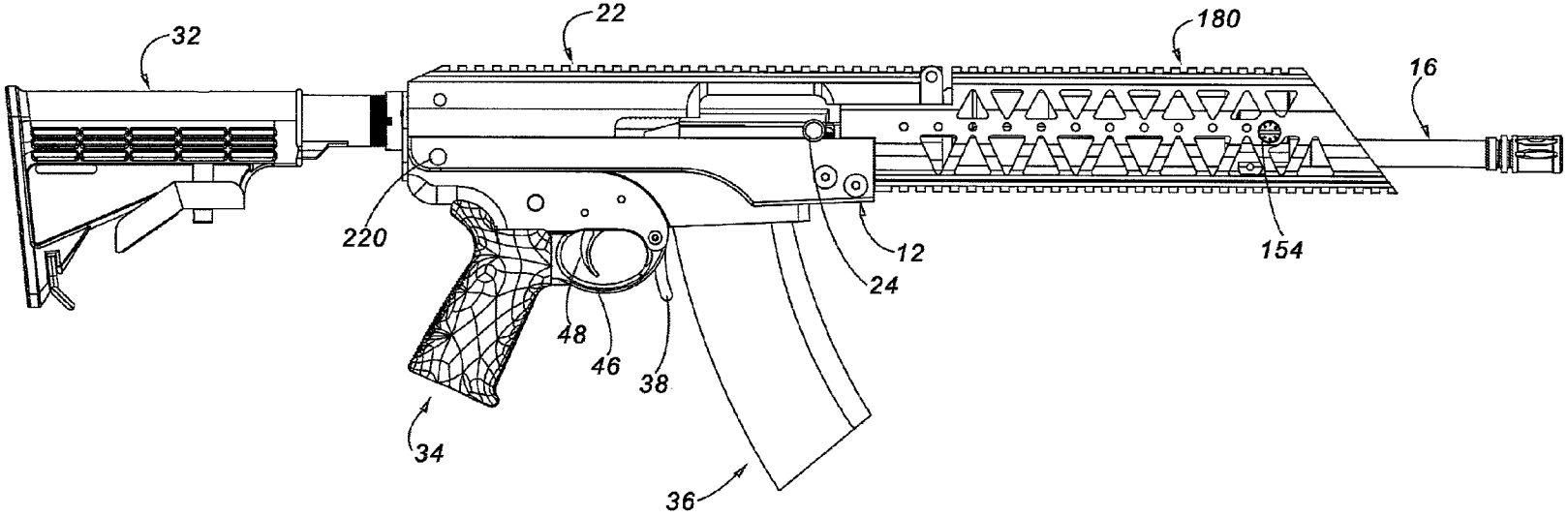
FIG. 2 is a side elevation view of the improved semiautomatic firearm of FIG. 1.
Figure 3:
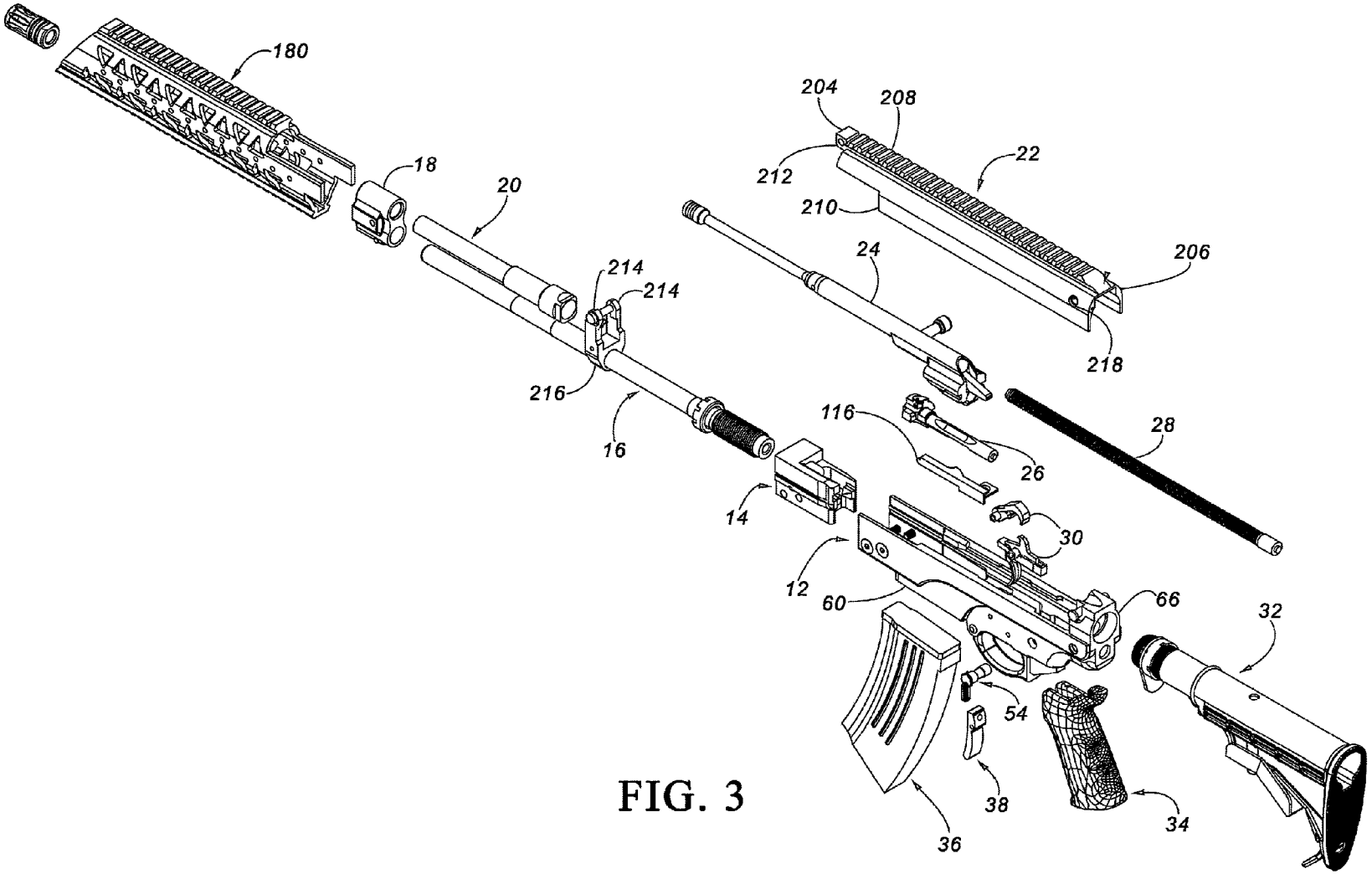
FIG. 3 is a side perspective exploded view of the improved semiautomatic firearm of FIG. 1.
Figure 4:
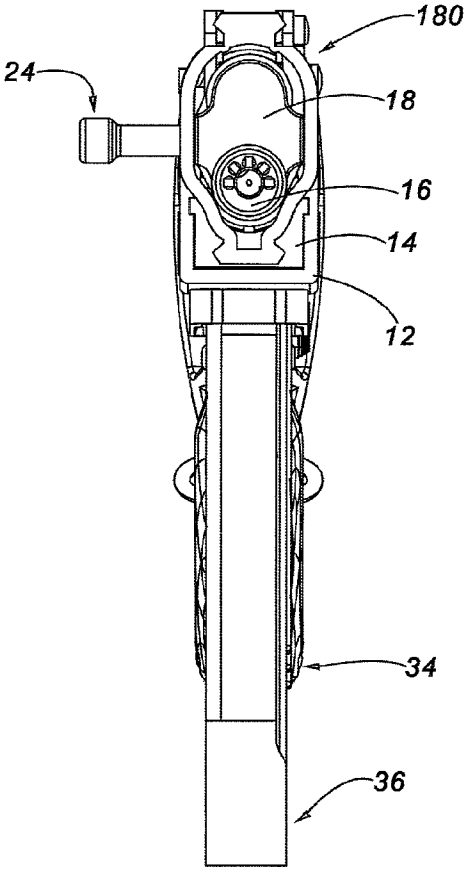
FIG. 4 is a front elevation view of the improved semiautomatic firearm of FIG. 1.
Figure 5:
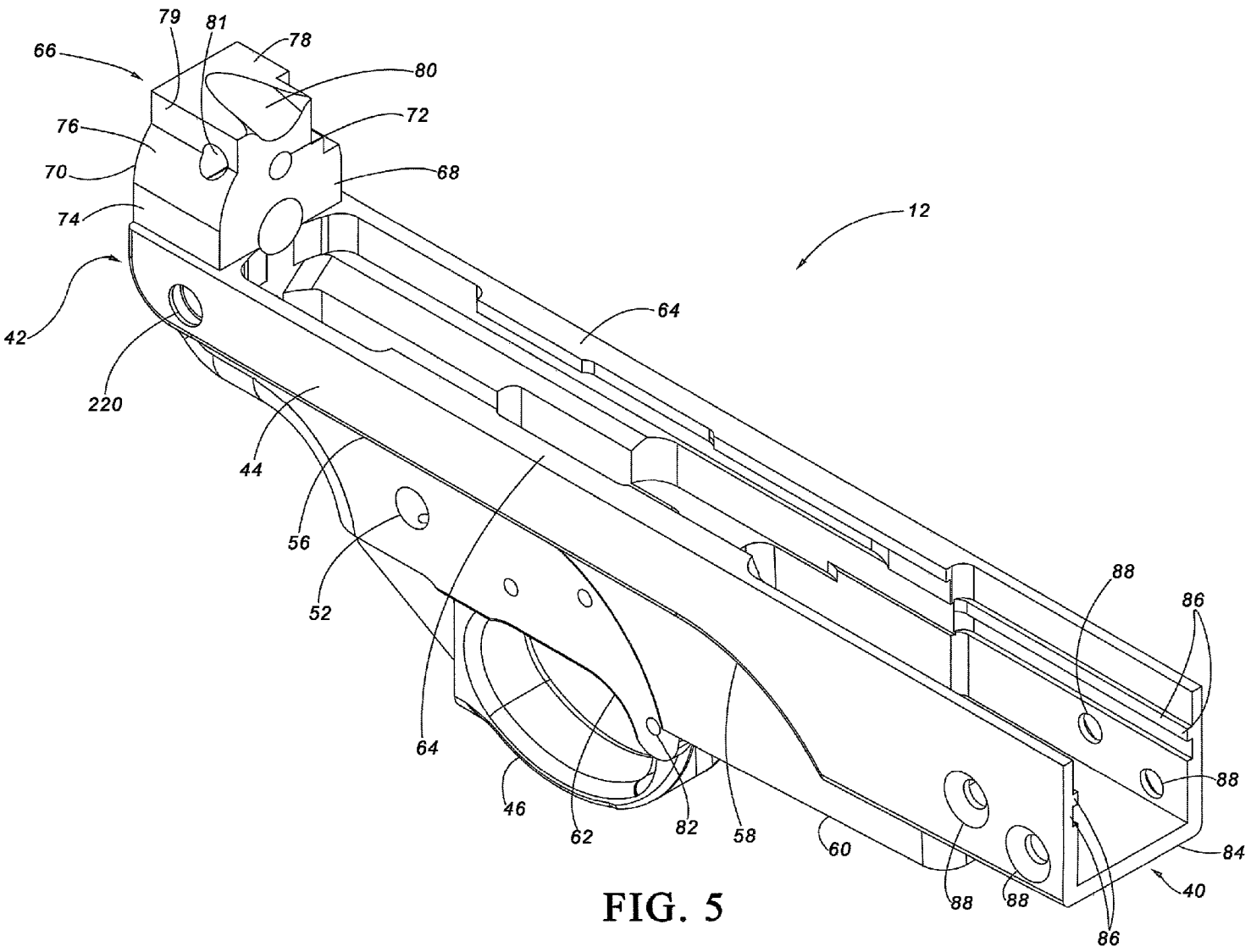
FIG. 5 is a side perspective view of the receiver of the improved semiautomatic firearm of FIG. 1.
Figure 6:
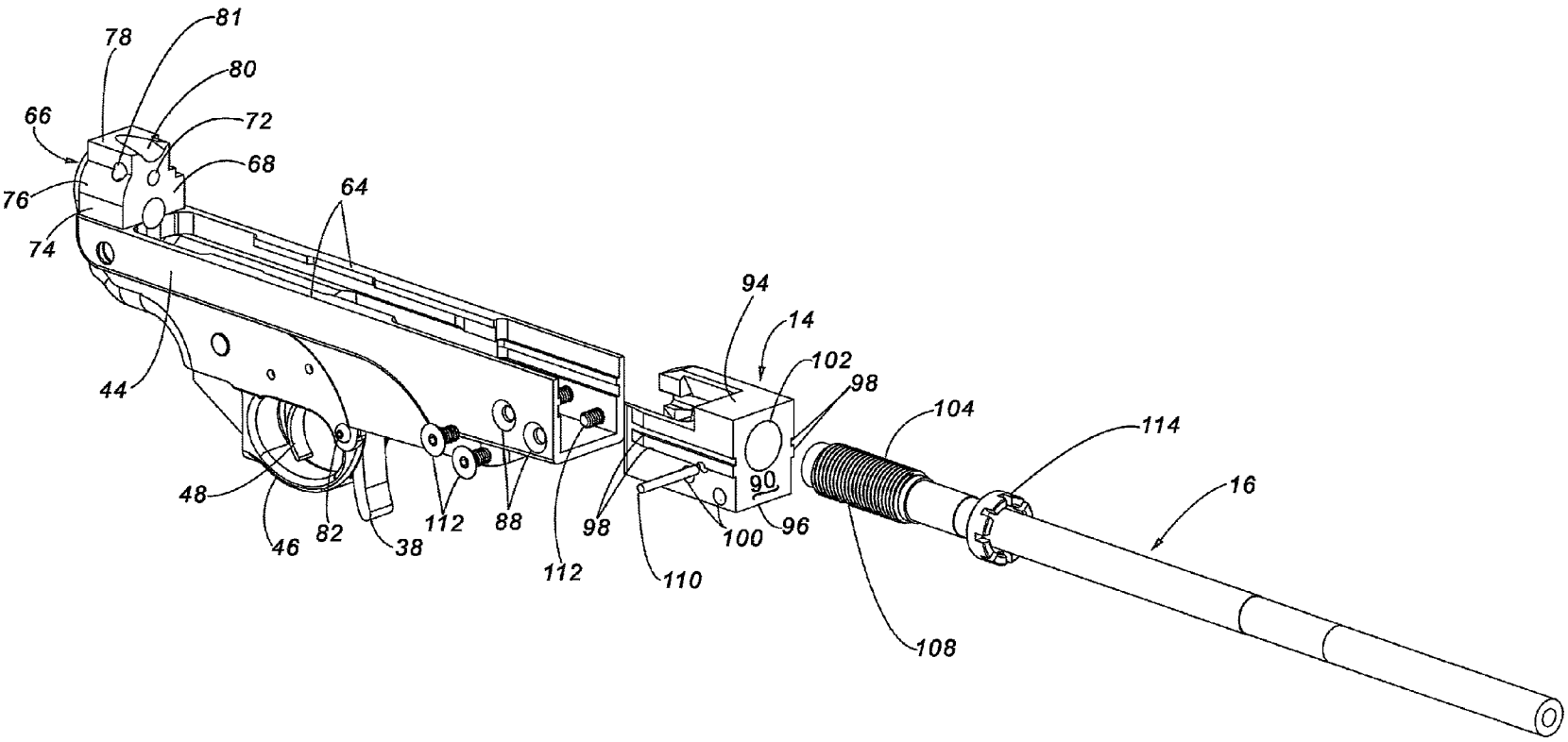
FIG. 6 is a side perspective exploded view of the receiver, trunnion and barrel of the improved semiautomatic firearm of FIG. 1.
Figure 7:
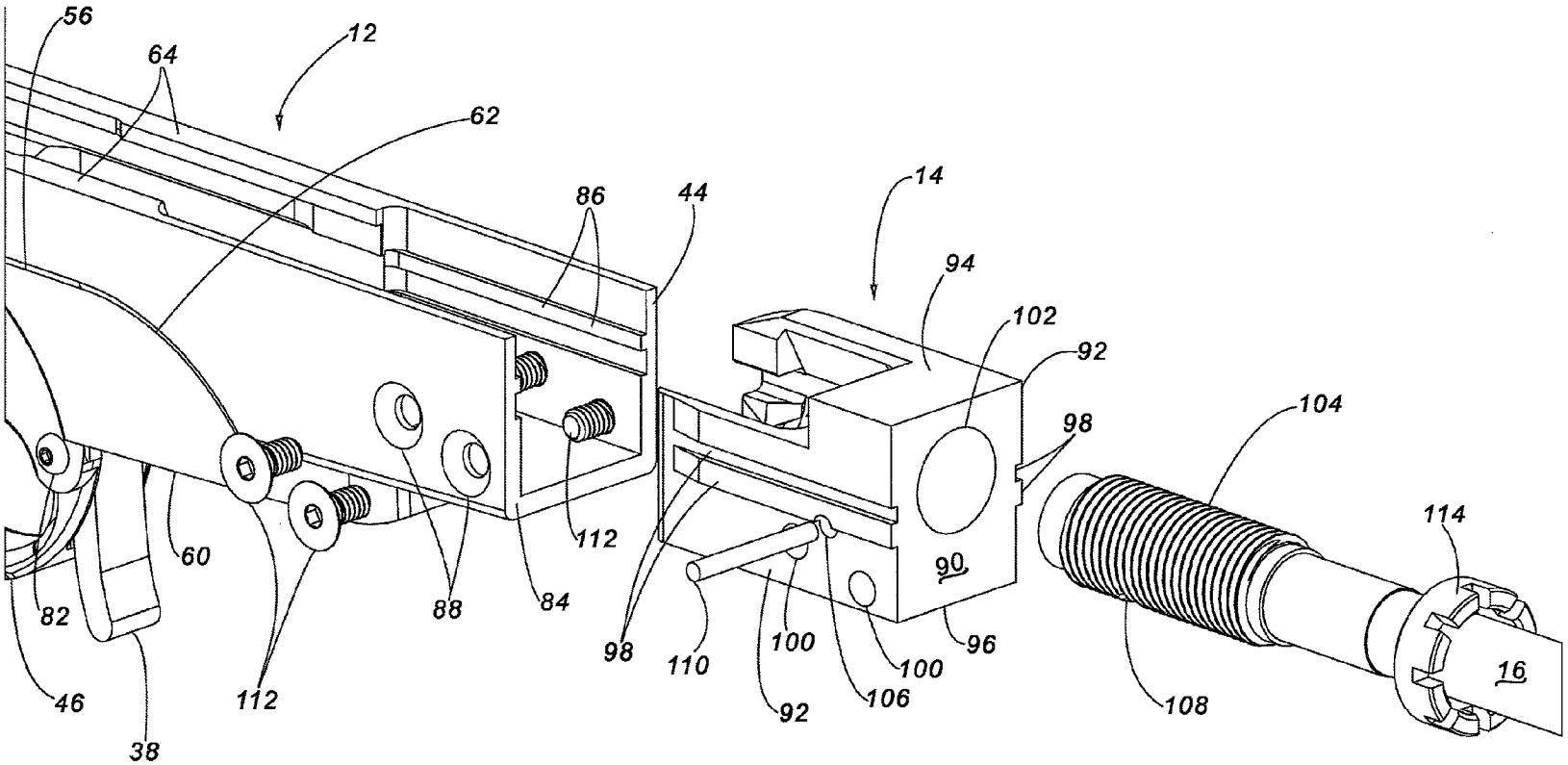
FIG. 7 is a close-up side perspective exploded view of the receiver, trunnion and barrel of the improved semiautomatic firearm of FIG. 1.
Figure 8:
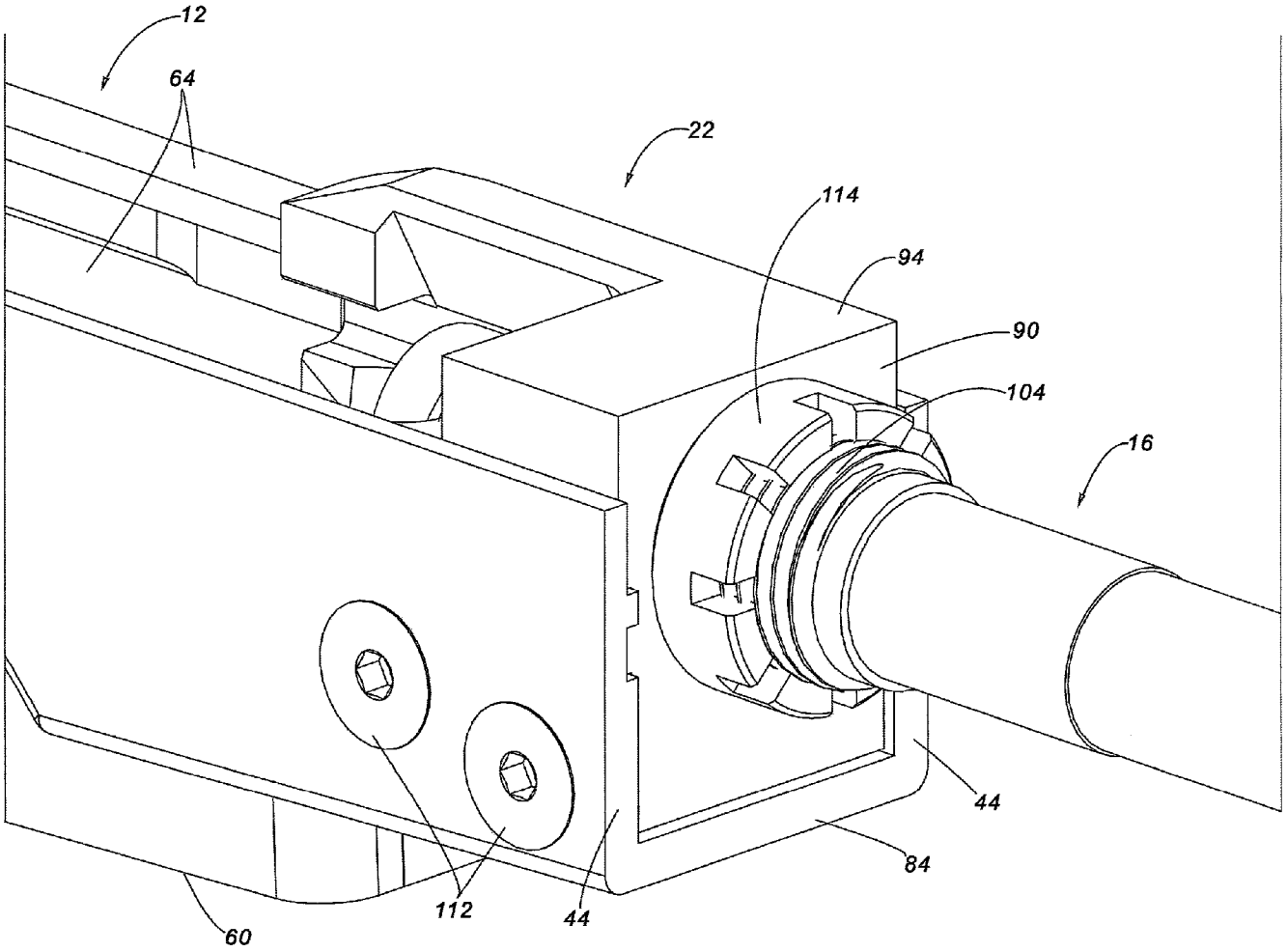
FIG. 8 is a perspective view of the assembled receiver, trunnion and barrel of the improved semiautomatic firearm of FIG. 1.
Figure 9:
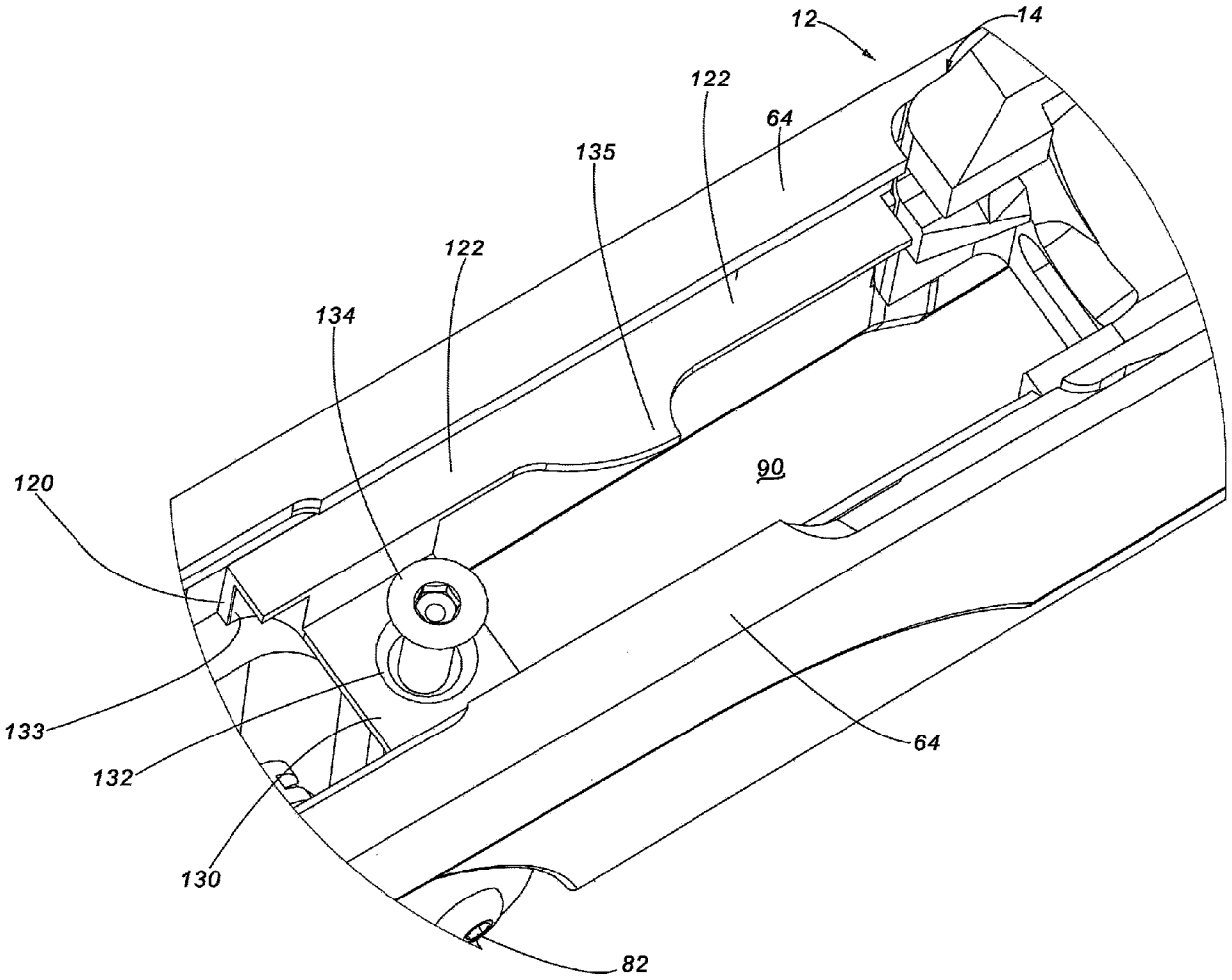
FIG. 9 is a top perspective view of the receiver and trunnion of the improved semiautomatic firearm of FIG. 1, the view showing the replaceable extractor having its forward end pinched between the trunnion and the receiver, and its rearward end in the process of being screwed down to the receiver.
Figure 10:
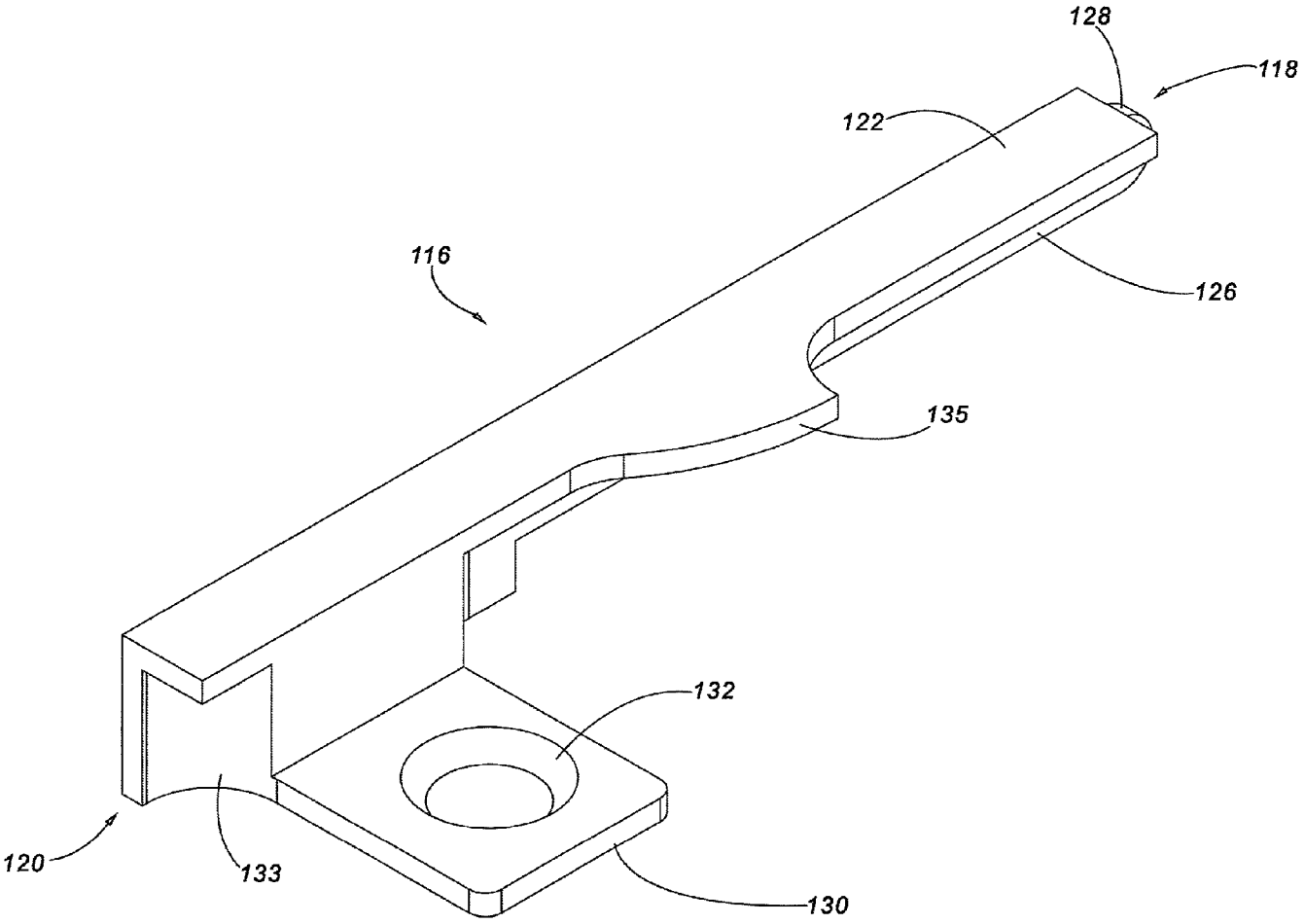
FIG. 10 is a side perspective view of replaceable extractor of the improved semiautomatic firearm of FIG. 1.
Figure 12:
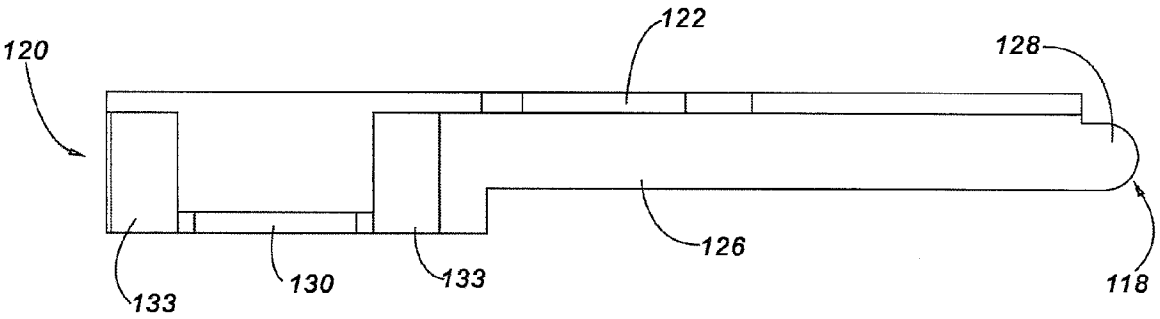
FIG. 12 is a side elevation view of replaceable extractor of the improved semiautomatic firearm of FIG. 1.
Figure 11:
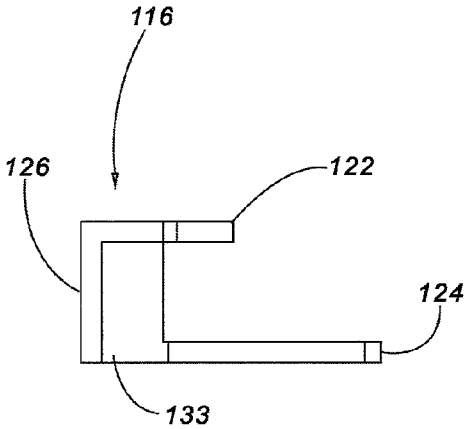
FIG. 11 is an end elevation view of replaceable extractor of the improved semiautomatic firearm of FIG. 1.
Figure 16:
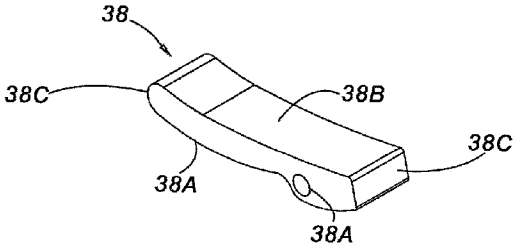
FIG. 16 is a side perspective view of the magazine release of the improved semiautomatic firearm of FIG. 1.
Figure 15:
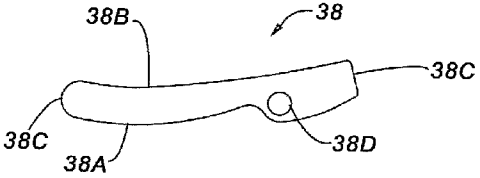
FIG. 15 is a side elevation view of the magazine release of the improved semiautomatic firearm of FIG. 1.
Figure 13:
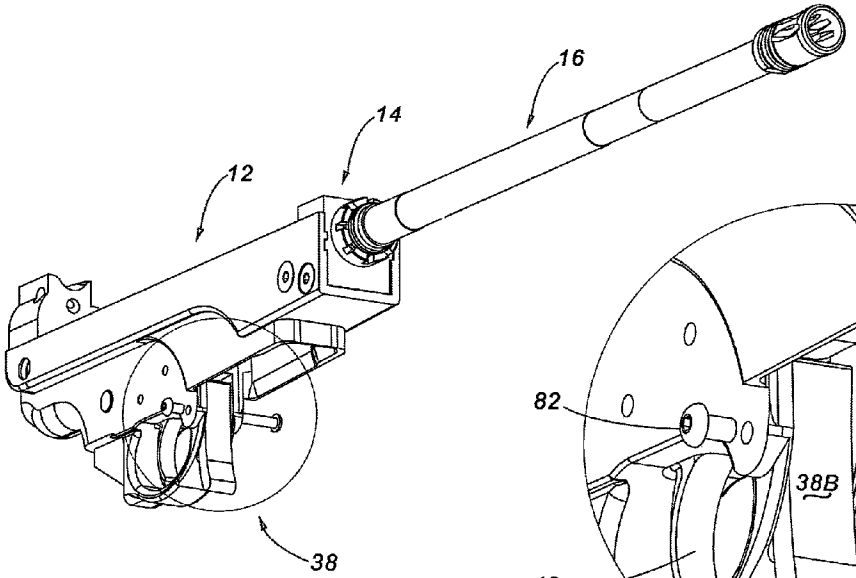
FIG. 13 is a side perspective view of the assembled receiver, trunnion and barrel of the improved semiautomatic firearm of FIG. 1, the view particularly showing the magazine release.
Figure 14:
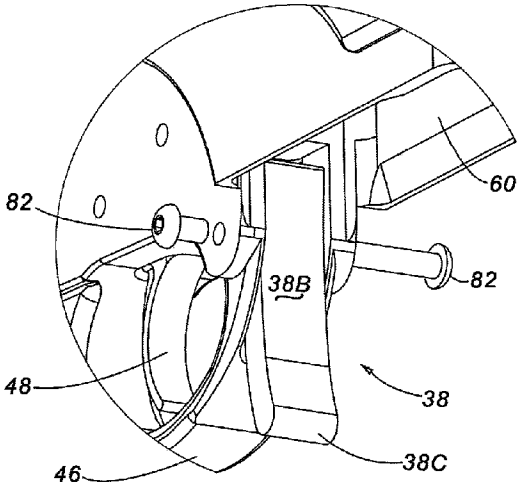
FIG. 14 is a close-up side perspective view of the assembled receiver and magazine release of the improved semiautomatic firearm of FIG. 1.
Figure 19:
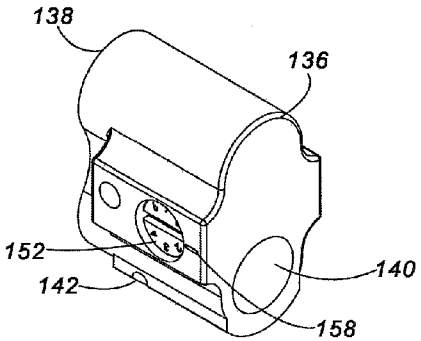
FIG. 19 is a close-up side perspective view of the adjustable gas block of the improved semiautomatic firearm of FIG. 1, the view showing the barrel and gas tube removed from the adjustable gas block.
Figure 21:
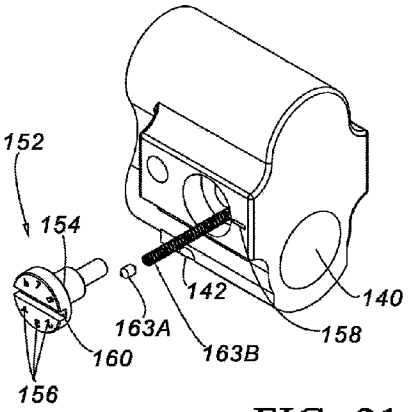
FIG. 21 is a close-up side exploded perspective view of the adjustable gas block of the improved semiautomatic firearm of FIG. 1, the view showing the adjustable member, pin and spring.
Figure 20:
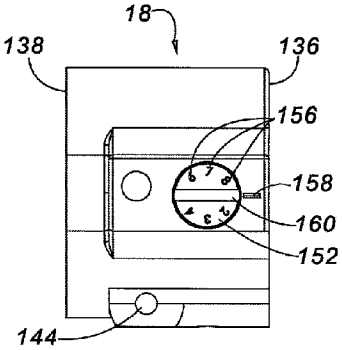
FIG. 20 is a close-up side elevation view of the adjustable gas block of the improved semiautomatic firearm of FIG. 1, the view showing the barrel and gas tube removed from the adjustable gas block.
Figure 18:
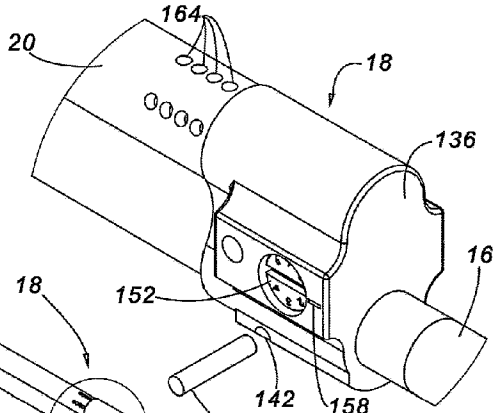
FIG. 18 is a close-up side perspective view of the adjustable gas block of the improved semiautomatic firearm of FIG. 1, the view showing the barrel and gas tube connected to the adjustable gas block.
Figure 22:
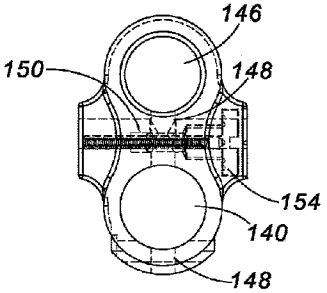
FIG. 22 is a close-up end elevation view of the adjustable gas block of the improved semiautomatic firearm of FIG. 1, the view showing the first gas bore and intersecting second gas bore in hidden lines.
Figure 17:
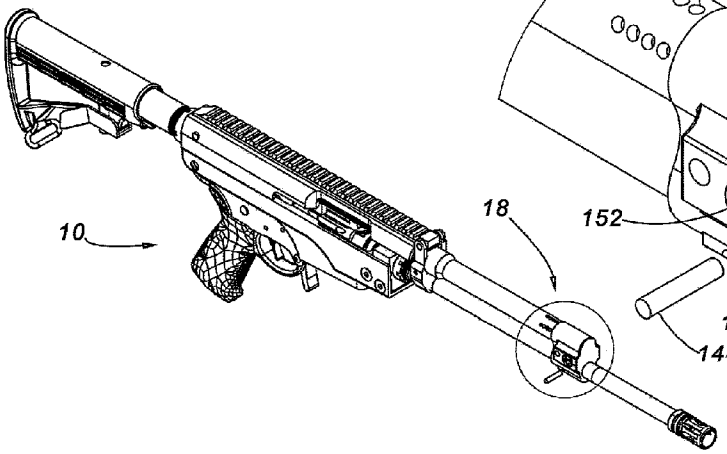
FIG. 17 is a side perspective view of the improved semiautomatic firearm of FIG. 1 with the foregrip removed and the view showing the adjustable gas block.
Figure 23:
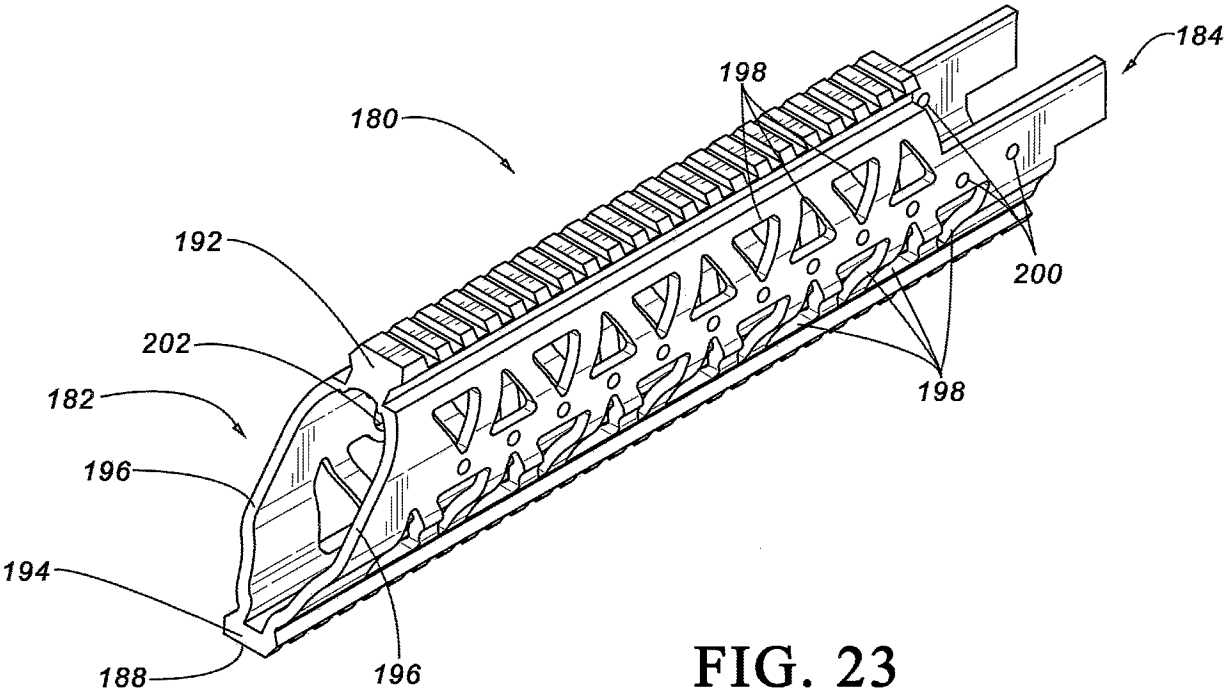
FIG. 23 is a perspective view of the foregrip of the improved semiautomatic firearm of FIG. 1.
Figure 24:
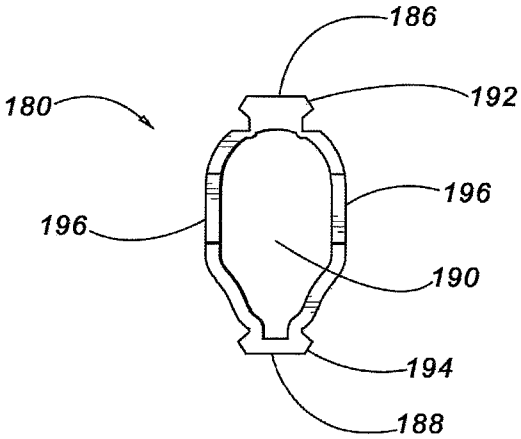
FIG. 24 is a front elevation view of the foregrip of the improved semiautomatic firearm of FIG. 1.
Figure 25:
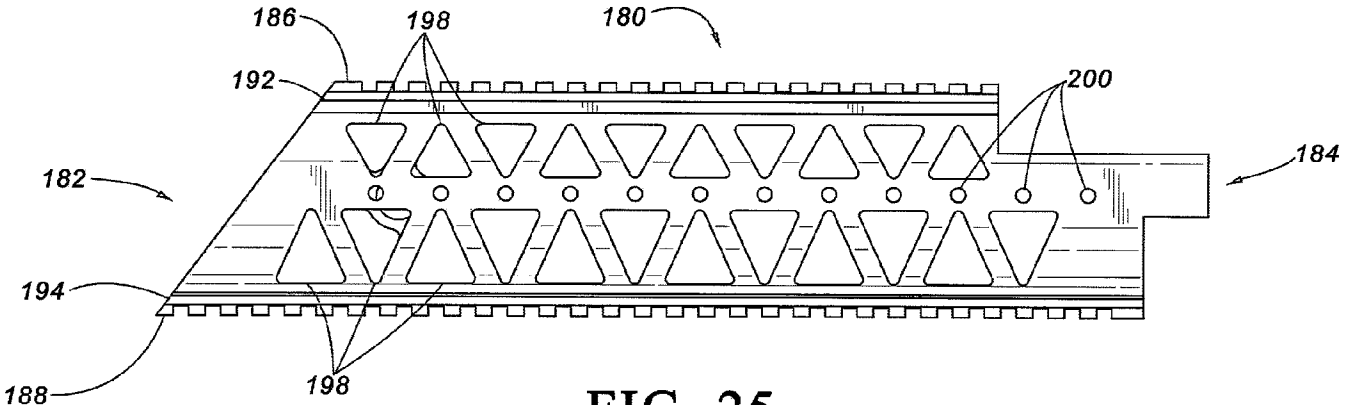
FIG. 25 is a side elevation view of the foregrip of the improved semiautomatic firearm of FIG. 1.
Figure 26:
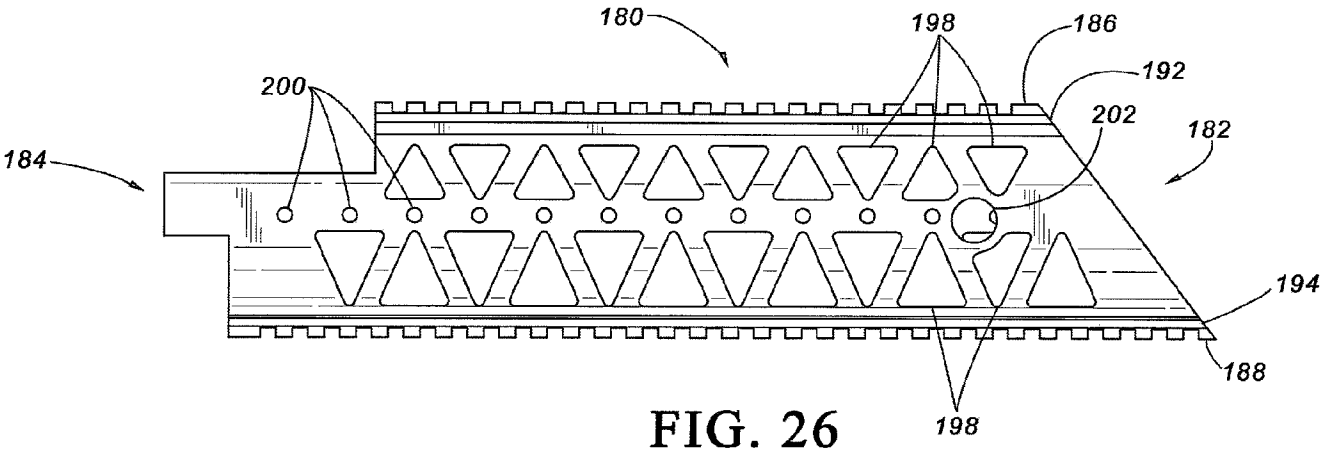
FIG. 26 is a side elevation view of the foregrip of the improved semiautomatic firearm of FIG. 1.
Figure 27:
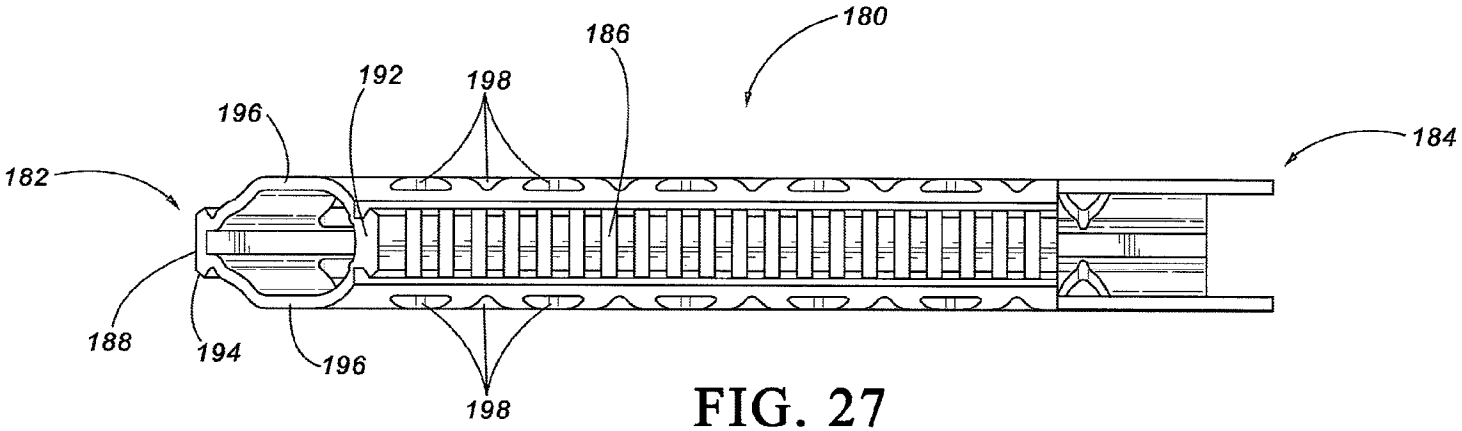
FIG. 27 is a top elevation view of the foregrip of the improved semiautomatic firearm of FIG. 1.
Figure 28:
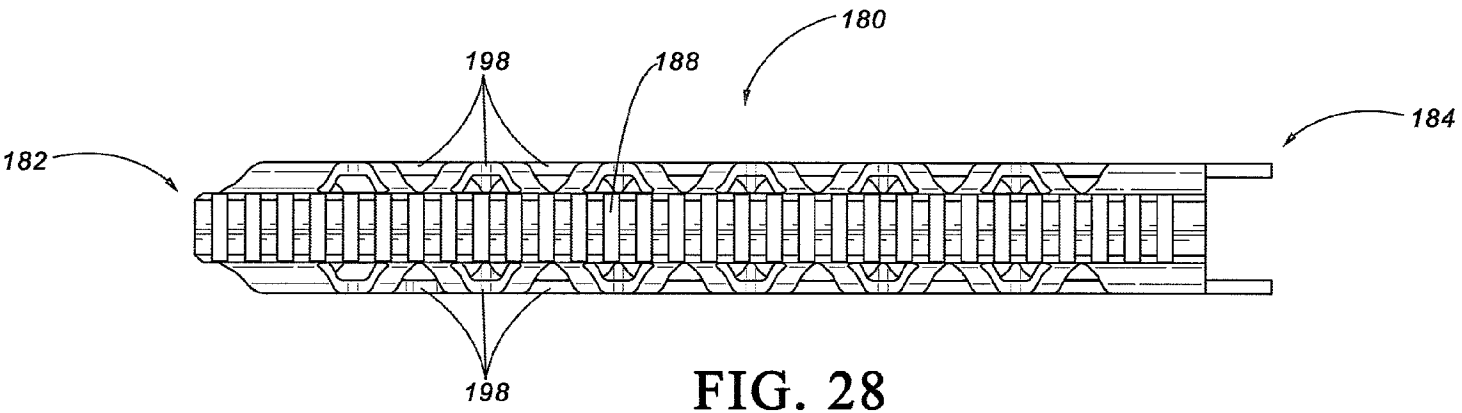
FIG. 28 is a bottom elevation view of the foregrip of the improved semiautomatic firearm of FIG. 1.

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the invention. The following detailed description is, therefore, not to be taken in a limiting sense, and the scope of the invention is defined only by the appended claims, along with the full scope of equivalents to which such claims are entitled.

As used herein, the terminology such as vertical, horizontal, top, bottom, front, back, end, sides, and the like, are referenced according to the views presented. It should be understood, however, that the terms are used only for purposes of description, and are not intended to be used as limitations. Accordingly, orientation of an object or a combination of objects may change without departing from the scope of the invention.

With reference to the figures a semiautomatic firearm system 10 is presented. The semiautomatic firearm 10 includes a receiver 12, a trunnion 14, a barrel 16, a gas block 18, a gas tube 20, a dust cover 22, a bolt carrier 24, a bolt 26, a recoil spring 28, a trigger assembly 30, a butt stock 32, a pistol grip 34, a magazine 36 and a magazine release 38 among other components.

Receiver: The receiver 12 is formed of any suitable size, shape and design. In the arrangement shown, the receiver 12 is formed of a single monolithic piece to provide superior strength and durability, and in one arrangement is machined out of aluminum which is then coated, hardened or otherwise treated to increase strength and durability. Receiver 12 extends a length between a forward end 40 and a rearward end 42 and includes a pair of opposing sidewalls 44 that extend there between in approximate parallel spaced relation. A trigger guard 46 extends outwardly from the bottom side of receiver 12 and forms a loop which holds and protects a conventional trigger 48. The open interior of receiver 12 is machined in an intricate manner to hold and operably receive a trigger assembly 50 (not intricately shown) that activates the firearm 10. In one arrangement, trigger assembly 50 is a conventional AR-15 style trigger assembly, which is known for its precision and smooth operation. Receiver 12 includes a safety opening 52 conveniently positioned rearward of trigger guard 46 that extends through receiver 12 from sidewall 44 to sidewall 44 and receives safety 54. Since, safety opening 52 extends through receiver 12, safety 54 can be placed on either side of receiver 12, also known as being ambidextrous, or providing the ability to have an ambidextrous safety.

Sidewalls 44 of receiver 12 narrow or neck down at first step 56 which extends in generally straight, level and parallel alignment with the length of receiver 12 adjacent the receiver's rear and middle, before terminating in a downwardly extending curved portion 58 which is positioned forward of trigger guard 46 adjacent the forward end 40 of receiver 12 and terminates above magazine well 60. A second step 62 again narrows the width of receiver and is formed of a curved portion that curves downward from first step 56 beginning above trigger guard 46 and terminating just forward of trigger guard 46. These inward steps 56, 62 allow for the lower portion of receiver 12 to be narrower than the upper portion, thereby reducing the amount of material utilized by receiver 12, and thereby reducing its weight and cost without sacrificing its strength. In addition, the smooth arcuate curve of curved portion 58 of first step 56 and the curved portion of second step 62 prevent any sharp edges that can get caught during use or operation, thereby improving the fit, feel and function of the firearm 10.

Receiver 12 terminates in an upper edge 64 which is generally straight and flat and extends from forward end 40 to rearward end 42. A stock mount 66 extends upwardly from the rearward end 42 of receiver 12 and serves as a mounting place for butt stock 32 as well as dust cover 22. Stock mount 66 has a generally flat and straight forward face 68 and rearward face 70 that extend in generally parallel spaced relation to one another. Stock mount 66 includes an opening 72 that extends through the stock mount 66 from the rearward face 70 to the forward face 68, the opening 72 being wider or larger in diameter in the rearward face 70 as it is in the forward face 68, and serves for receiving a conventional AR-15 style butt stock. Stock mount 66 includes opposing sides 74 that extend upward from upper edge 64 before terminating in a curved portion 76 that connect at their upper edge to a flat mounting platform 78 which is positioned above a vertically rising step 79. Mounting platform 78 includes a curved opening 80 therein, which is formed to receive or make room for a portion of dust cover 22. A mounting opening 81 is extends from side-to-side into and/or through stock mount 66 and is used for mounting the rearward end of dust cover 22 thereto. In one arrangement, mounting opening 81 is designed to receive a conventional mounting pin, or fastener (such as a screw or bolt or the like) that extends through dust cover 22 and into mounting opening 81 thereby mounting the rearward end of dust cover 22 to receiver 12. In the arrangement shown, mounting opening 81 is positioned at the interface of step 79 and curved portion 76 and covers a portion of both.

Receiver 12 includes a magazine release 38 pivotally connected thereto. Magazine release 38 is positioned forward of trigger guard 46 and rearward of magazine well 60 and connects at pivot point 82 by a conventional fastener, such as a screw, bolt, pin or the like. Magazine release 38 when viewed from the side is arcuately curved such that the convex face 38A faces rearward and the concave face 38B faces forward. The magazine release 38 and has a generally extended vertical length between opposing ends 38C. Magazine release 38 also includes an opening 38D that is positioned near its rearward and upper side that receives a conventional fastener such as a pin, bolt or screw of the like upon which magazine release 38 pivots. This arrangement provides for easy and quick activation of the magazine release 38 and replacement of magazines 36.

Forward end 40 of receiver 12 removably and replaceably receives trunnion 14. Forward end 40 of receiver 12 is generally flat and square, with a flat center wall 84 extending between opposing sidewalls 44 at their lower ends. Center wall 84 is generally positioned in perpendicular alignment with opposing sidewalls 44. The interior surfaces of center wall 84 and opposing sidewalls 44 are generally flat, however to provide alignment for trunnion 14, the forward end of receiver 12 includes one or more alignment features 86, either positioned in one or both sidewalls 44 and/or center wall 84. In the arrangement shown, alignment features 86 are formed of a single generally square or rectangular groove in the interior sides of each sidewall 44 and extend rearward a distance from the forward edge 40 of receiver 12 in a generally flat, level and parallel alignment to the length of receiver 12. While a single alignment feature 86 is shown in each of the sidewalls 44, it is hereby contemplated that more than one alignment features 86 may be positioned in each of the sidewalls 44 and/or center wall 84, such as two or three alignment features 86 in each of the sidewalls 44. It is also hereby contemplated that alignment features 86 may be placed in the center wall 84 as well. Also, while a groove is shown for use as an alignment feature 86, it is also contemplated, that a protrusion, such as a rail or extended feature can be used, or a combination of grooves and protrusions can be used.

At least one mounting hole 88 is positioned in sidewalls 44 adjacent the forward end 40 of receiver 12 and are used to mount trunnion 22 to receiver 12. In the arrangement shown, a pair of mounting holes 88 are positioned in each of the opposing sidewalls 44, one mounting hole 88 positioned forward of the other by a distance, and the forward most mounting hole 88 positioned a distance below the rearward mounting hole 88. In the arrangement shown, mounting holes 88 are countersunk, such that a fastener having a beveled head inserted into mounting hole 88 does not protrude or interfere with the smooth exterior surface of sidewall 44.

This arrangement of alignment features 86 and laterally and vertically offset and staggered mounting holes 88 provides for a strong and stable mounting arrangement for trunnion 22 without any undesired movement or wiggle. This arrangement however still allows for trunnion 22 to be quickly and easily removed and replaced without the need for excess force or specialized tooling or experience.

Trunnion: Trunnion 22 is formed of any suitable size, shape and design and is sized and shaped to be inserted into the forward end 40 of receiver 12. In the arrangement shown, trunnion 22 is formed of a single unitary monolithic piece and includes a generally flat forward wall 90 with generally flat opposing sidewalls 92 and a generally flat top wall 94 and a generally flat bottom wall 96. Trunnion 22 includes alignment features 98 that are sized and shaped to engage and mate with the alignment features 86 in the forward end 40 of receiver 12. In the arrangement shown, alignment features 98 are formed of a squared protrusion or rail extending outwardly from each sidewall 92 and positioned adjacent to a groove that fits within the mirrored grooves and protrusions shown as the alignment features 86 in receiver 12. However, it is hereby contemplated that any other form of an alignment feature 98 can be used in each of the sidewalls 92, and it is also hereby contemplated that a plurality of grooves and/or rails can be used instead of rails, or any other opposite feature to those alignment features positioned in receiver 12. In the arrangement shown, to assist with and ease the insertion of trunnion 22 into receiver 12 the rearward edge of alignment features 86 are angled, rounded or chamfered.

Like receiver 12, trunnion 22 includes mounting holes 100 that extend into trunnion 22 and include a threaded bore. Mounting holes 100 of trunnion 22 align with the mounting holes 88 of receiver 12 when trunnion 22 is fully inserted into receiver 12. That is, in the arrangement shown, a pair of mounting holes 100 are positioned in each of the opposing sidewalls 92, one mounting hole 100 positioned forward of the other by a distance, and the forward most mounting hole 88 positioned a distance below the rearward mounting hole 88. This arrangement of mating alignment features 86, 98 and laterally and vertically offset and staggered mounting holes 88, 100 provides for a strong and stable mounting arrangement for trunnion 22 into receiver 12 without any undesired movement or wiggle. This arrangement however still allows for trunnion 22 to be easy and quickly removed and replaced. It is hereby contemplated that any other arrangement or spacing or number of mounting holes 100 is hereby contemplated for use.

Trunnion 22 includes a threaded bore 102 that is sized and shaped to threadably receive threaded end 104 of barrel 16. A locking pin opening 106 is positioned in the trunnion 22 and extends through trunnion 22. Locking pin opening 106 intersects with threaded bore 102 that extends inward into trunnion 22 from forward wall 90 and receives the threaded end 104 of barrel 16. Similarly, the threaded end 104 of barrel 16 includes a locking pin opening 108 therein such that when the barrel 16 is fully threaded into the threaded bore 102 of trunnion 22 the locking pin opening 106 of trunnion 22 aligns with the locking pin opening 108 of barrel 16, which defines the fully inserted position. Once in this position, locking pin 110 is inserted into the aligned locking pin openings 106, 108 thereby locking the barrel into trunnion 22. This arrangement ensures proper alignment of the barrel 16 with respect to the trunnion. The locking pin 106 and threaded engagement of the threaded end 104 of barrel 16 also allows for simple, quick and easy removal and replacement of barrel 16. Noticeably, when trunnion 22 is inserted within receiver 22, locking pin 106 is covered by sidewalls 44 of receiver 12 thereby completely preventing unintentional removal of locking pin 106 which provides additional safety and security.

Once the barrel 16 is installed into the trunnion 22, the trunnion 22 is installed into the receiver 12. In doing so, the alignment features 98 of the trunnion 22 are aligned with the alignment features 86 of the receiver 12 and the trunnion 22 is slid rearward until the mounting holes 100 of the trunnion align with the mounting holes 88 of the receiver, which defines a fully inserted position. Once in this position, conventional fasteners 112 are inserted through the mounting holes 88, 100 until tight.

A nut 114 is positioned over barrel 16 and threaded onto the threaded end 104. Nut 114 is tightened against the forward wall 90 of trunnion 22 thereby providing additional securement to barrel 16. In one arrangement, after being tightened, nut 114 is held in place with a locking screw, locking pin or other locking mechanism.

In one arrangement trunnion 22 is formed of hardened steel whereas receiver 12 is formed of aluminum or an aluminum alloy or other hard but light weight alloy. In this arrangement, the hardened steel of trunnion 22 provides superior wear resistance and long useful life. However, it is heavier than the lighter, but softer, aluminum of the receiver 12. This arrangement, wherein the receiver 12 is formed of a first material that is lighter but less durable and the trunnion 22 is formed of a second material that is heavier but more durable, provides a useful balance between durability and weight for firearm 10.

The rearward side and open interior of trunnion 22 includes the necessary features, including the chamber, that cooperate with the features of the receiver 12, magazine 36, bolt carrier 24, bolt 26 and the other components of the system 10 necessary for loading and unloading of cartridges and operation of firearm 10 in a semiautomatic, and/or fully automatic manner.

Replaceable Extractor: A replaceable extractor 116 is connected to the receiver 12 and trunnion 12. Extractor 116 is formed of any suitable size, shape and design. Extractor 116 is a high-wear part. Meaning that during the operation of the firearm 10, the bolt 26 and bolt carrier 24 slide on, over and/or engage the stationary extractor 116 which act in cooperation with one another to cause the function of the bolt 26 and bolt carrier 24 to eject the spent cartridge from the firearm 10 after firing and load the next cartridge from magazine 36. Due to the high-wear nature of extractor 116, replacement of extractor 116 is often necessary over time. Despite the need to replace extractor 116 over time, prior art firearms made it difficult if not impossible to remove and/or replace the extractor by forming the extractor directly into the receiver or welding or otherwise permanently affixing the extractor into the firearm. Also, by prior art firearms forming the extractor out of the material of the receiver, this prevented using a different and harder material for the extractor than is used for the receiver.

In the arrangement shown, extractor 116 is easily removable and replaceable. Extractor 116 extends a length from a forward end 118 and a rearward end 120. When viewed from an end 118, 120, extractor 116 is formed in a C-shape, U-shape, J-Shape or channel-shape having an upper wall 122 that extends in a generally parallel spaced relation to a bottom wall 124 which are connected to one another by a center wall 126 which extends in a perpendicular relation to the upper wall 122 and bottom wall 124. The forward end 118 of center wall 126 includes a side tab 128 that, when extractor 116 is installed into receiver 12, side tab 128 is pinched between receiver 12 and trunnion 22. Extending outwardly from bottom wall 128, adjacent rearward end 120, is a bottom tab 130. Bottom tab 130 includes a mounting opening 132 therein that receives a conventional fastener 134 there through. In the arrangement shown, mounting opening 132 is countersunk such that when fastener 134 having a beveled head is inserted therein, the upper surface of bottom tab 130 is flat, smooth and flush so as to prevent interference with other components of the system 10. Or, said another way, the upper surface of fastener 134 is flush with, or slightly recess with respect to, or does not protrude above the upper surface of bottom tab 130. When extractor 116 is installed into receiver 12, bottom tab 130 engages the receiver 12 and mounting opening 132 aligns with a threaded mounting hole therein that threadably receives fastener 134.

Extractor 116 also includes a tooth 135 which extends outward from upper wall 122, in the same direction as bottom tab 130. Tooth 135 is placed between forward end 118 and rearward end 120, forward of bottom tab 130. Tooth 135 is formed of any suitable size, shape and design and serves to function bolt carrier 24 and bolt 26 as the reciprocate within receiver 12 so as to cause ejection of a spent casing and reloading of a new and unfired round. In the arrangement shown, the rearward side of tooth 135 is curved in a smooth and convex manner that connects at a point at its forward end to a steeper concave curved surface on its forward end. As is also shown, center wall 126 is thicker adjacent bottom tab 130 and includes a rounded groove 133 that extends vertically from the bottom side of upper wall 122 to the bottom surface of extractor 116. Rounded groove 133 is positioned just rearward of bottom tab 130 and connects to the rearward end 120 of extractor 116. A second rounded groove 133 is positioned just forward of bottom tab 130 and extends vertically from the bottom side of upper wall 122 to the bottom surface of extractor 116. This second rounded groove 133 connects between the forward side of bottom tab 130 and the inner surface of center wall 126. Extractor 116 includes any other necessary features to cause necessary function of firearm 10.

In this way, extractor 116 is easily installed and removed from receiver 12 by pinching the side tab 128 between the receiver 12 and trunnion 22, which secures the forward end 118 of extractor 116, and screwing the bottom tab 130 to the threaded opening in receiver 12, which secures the rearward end 120 of extractor 116. In this arrangement, the side tab 128 fits within or is received within a groove or recess in trunnion 14. In this way, extractor 116 is securely mounted into receiver 12, while being easily removed in and replaced. This arrangement allows extractor 116 to be formed of a harder and heavier material, such as a heat-treated hardened steel that provides superior wear resistance over the softer but lighter aluminum-type material that receiver 12 is formed of.

In the arrangement shown in the figures, a right-hand extractor is presented. One benefit of the configuration of receiver 12 and trunnion 14 is that the firearm 10 can quickly and easily be changed to left-hand operation by replacing the extractor 116 with a mirror-image or reverse-version of the extractor 116 shown, which installs and functions in the same manner described herein.

Adjustable Gas Block: An adjustable gas block 18 is connected between the barrel 16 and the gas tube 20. Adjustable gas block 18 is formed of any suitable size, shape and design. In the arrangement shown, adjustable gas block 18 is formed of a single unitary solid monolithic piece for superior strength, rigidity, durability and life.

Gas block 18 includes a forward end 136 and a rearward end 138. Positioned adjacent the lower end of gas block 18 is a barrel opening 140 that extends through gas block 18 from forward end 136 to rearward end 138 and is sized and shaped to receive and slide over the outside diameter of barrel 16.

Positioned below barrel opening 140 is a locking pin opening 142. Locking pin opening 142 extends partially or fully through gas block 18 from side-to-side. Locking pin opening 142 intersects at least a portion of barrel opening 140. When gas block 18 is fully inserted over and in position on barrel 16, locking pin opening 142 aligns with a groove or similar opening in the bottom portion of barrel 16. Once in this position, locking pin 144 is inserted into locking pin opening 142 and extends into the groove in barrel 16 thereby locking gas block 18 in position on barrel 16.

A gas tube opening 146 extends in generally parallel spaced relation to barrel opening 140. Gas tube opening 146 extends from rearward end 136 into the body of gas block 18 a distance, however gas tube opening 146 does not extend all the way through gas block 18. That is, gas tube opening 146 does not intersect forward end 136 of gas block 18.

Gas block 18 includes a first gas bore 148 that extends through the portion of material that separates the barrel opening 140 and the gas tube opening 146. In the arrangement shown, first gas bore 148 extends vertically upward from the center bottom side of gas block 18, through barrel opening 140 and through the material positioned between barrel opening 140 and gas tube opening 146. In the arrangement shown, first gas bore 148 is centrally positioned between the sides of gas block 18. In the arrangement shown, first gas bore 148 does not extend through the upper side of gas block 18. When gas block 18 is in position over barrel 16, the first gas bore 148 aligns with an opening in the barrel 16 that extends through the material of the barrel 16 and into the bore of the barrel 16. In this way, the alignment of the first gas bore 148 with the opening in the barrel 16 provides a passageway for a portion of the escaping gases from an expelled round to move through the opening in the barrel 16, through the material of the gas block 18 separating the barrel opening 140 and the gas tube opening 146 and into the gas tube opening 146. This portion of the gasses is then used to operate the firearm 10.

A second gas bore 150 intersects the first gas bore 148. In the arrangement shown, second gas bore 150 extends transverse or perpendicular to the first gas bore 148. In the arrangement shown, second gas bore 150 extends inward from a side of the gas block 18 through first gas bore 148 and terminates in the material of gas block 18 past first gas bore 148 without extending all the way through the other side of gas block 18, however in an alternative arrangement the second gas bore 150 extends through the entirety of gas block 18 from side-to-side. In an alternative arrangement, second gas bore 150 intersects first gas bore 148 in any other manner, such as at an angle or even in parallel alignment to the first gas bore 148.

In one arrangement, second gas bore 150 is threaded and threadably receives an adjustable member 152 that adjustably extends into second gas bore 150 and adjustably extends across first gas bore 148 a distance. In a fully closed position, or a fully inserted position, adjustable member 152 extends all the way across first gas bore 148 and engages the material of gas block 18 on the opposite side of first gas bore 148 thereby closing the first gas bore 148. When in this position, adjustable member prevents all or most of the gasses from passing through the first gas bore 148. This prevents the firearm 10 from cycling and essentially turns the semiautomatic firearm into a single-shot firearm.

In a fully opened position, or a fully withdrawn position, adjustable member 152 is fully withdrawn from first gas bore 148. That is, in this position, no portion of adjustable member 152 extends into the first gas bore 148 and as such the adjustable member 152 does not inhibit the gasses from flowing through the first gas bore. In this position, the maximum force of gas is transmitted from the barrel 16 into the gas tube opening 146.

Adjustable member 152 is infinitely adjustable between any position between a fully opened position and a fully closed position by rotating the adjustable member 152 in a first direction and by rotating the adjustable member 152 in a second direction, opposite the first direction. This allows for infinite and precise adjustment of the amount of gasses allowed to transfer from the bore of barrel 16 through gas block 18 and into gas tube 20. This allows for the firearm 10 to be precisely tuned for smooth operation regardless of the conditions of operation and type of ammunition being used.

To aid in the adjustment of adjustable member 152 a detent mechanism 154 is connected to the outward end of adjustable member 152. Detent mechanism 154 is formed of any suitable size, shape and design. In the arrangement shown, detent mechanism 154 includes an outwardly facing face that has a greater diameter than the adjustable member 152 and second gas bore 150. The face of detent mechanism 154 includes a plurality of indicia 156 thereon that identify the position of the adjustable member 152 with respect to a reference mark 158 that is placed on gas block 18 adjacent the detent mechanism 154. The face of detent mechanism 154 also includes an operating mechanism 160 that is used to adjust the adjustable member 152, such as a flat head screwdriver recess, a Philips head screwdriver recess, a square drive recess, an Allen wrench recess, or any other recess or protrusion that can be used to rotate detent mechanism 154. The detent mechanism 154 sits within a recess 162 in the side of gas block 18 that is centered on the second gas bore 150 and sized and shaped to receive detent mechanism 154.

In one arrangement, detent mechanism 154 includes a plurality of detents that provide demarcation between increments of adjustment of the adjustable member 152. In one arrangement, as an example, the detents are formed of a plurality of recesses that selectively engage a pin 163A or ball bearing which is held between the detent mechanism 154 and the gas block 18 or within the detent mechanism 154 under a spring bias generated by spring member 163B which is held within its own bore or opening in gas block 18. In this arrangement, as the detent mechanism is rotated, the pin 163A or ball bearing selectively settles into each of the recesses in the rear side of detent mechanism and the indicia 156 indicates which position has been selected as compared to the reference mark 158.

In an alternative arrangement, first gas bore 148 extends all the way through gas block 18 and the adjustable member 152 extends downward from the top of gas block 18 to open and close the first gas bore 148.

Once gas block 18 is installed onto barrel 16, the forward end of gas tube 20 is inserted into the rearward facing gas tube opening 146 thereby holding the forward end of gas tube 20 in place. A plurality of ports 164 are positioned in the upper side of gas tube 20 adjacent to where it connects to gas block 18. Ports 164 allow for gas to escape the gas tube 20 shortly after transferring through first gas bore 148 and engaging the forward end of bolt carrier 24.

In an alternative arrangement gas block 18 does not include an adjustable member. Instead, in this arrangement, the dimensions of the first gas bore 148 are fixed and are dimensioned to operate firearm 10 regardless of the ammunition used.

Foregrip: Once the gas block 18 is installed on the barrel 16 and the gas tube 20 is connected to the gas block 18, foregrip 180 is installed over the barrel 16, gas block 18 and gas tube 20. Foregrip 180 is formed of any suitable size, shape and design. In the arrangement shown, as one example, foregrip 180 is formed of a single unitary, monolithic piece of material for strength, durability, rigidity and long life. In one example foregrip 180 is formed of a metallic material such as aluminum or an aluminum type material such as an aluminum alloy for durability and long useful life as well as being light weight. However, it is hereby contemplated that the foregrip may be formed of a plastic, composite, carbon fiber, nylon fiber, or any combination thereof, or any other non-metallic material that is sufficiently rigid and strong.

Foregrip 180 extends between a forward end 182 and a rearward end 184. The forward end 182 slants downward and outward as it extends from a top edge 186 to a bottom edge 188. Foregrip 180 includes a hollow interior 190. The top edge 186 and bottom edge 188 extend in generally parallel spaced relation to one another and include a top rail 192 and a bottom rail 194 that is used to mount components, such as scopes, flashlights, bipods, grips, and the like, thereto. These rails 192, 194 extend a portion of or the entire length of the top edge 186 and bottom edge 188 of foregrip 180 to provide the greatest amount of adjustment for mounted components. One form of a rail of this nature is known as a Picitany rail, which is a standard configuration for many firearms and components, includes a groove that extends the length of the rail on either side and a plurality of grooves that extend across the top or bottom surface, perpendicular to the side grooves.

Foregrip 180 includes a pair of opposing sidewalls 196 that extend opposite one another between top rail 192 and bottom rail 194. The center portions of sidewalls 196 are generally flat and positioned in parallel spaced relation to one another whereas the upper and lower portions of sidewalls 196 arcuately curve or angle inward from the flat portions towards the side grooves of rails 192, 194 thereby defining the hollow interior 190 there between.

Sidewalls 196 include a plurality of venting openings 198 and mounting holes 200 positioned therein. Venting openings 198 are formed of any suitable size, shape and design. In the arrangement shown, venting openings 198 are formed of a plurality of triangular openings that are aligned in a pair of rows, an upper row positioned between the top rail 192 and a mid-line of the foregrip 180; and a lower row positioned between the mid-line of foregrip 180 and bottom rail 194. In the arrangement shown, the upper row of triangular openings are slightly smaller than the lower row of triangular openings.

As shown, as an example, venting openings 198 are arranged in a pattern of oppositely pointing triangles. That is, each triangle shaped opening is bounded by other triangle shaped openings that point in the opposite direction. As is shown, as an example, the rearward most upper triangular opening is pointing downward, whereas the next triangular opening is pointing upward, whereas the next triangular opening is pointing downward, and so on. This arrangement of oppositely pointing triangular shaped openings maximizes that amount of airflow through foregrip 180 and minimizes the amount of material that is needed to form foregrip 180 while still providing substantial structural rigidity and a comfortable web of material for the user to grasp. By aligning the triangular openings in opposite pointing directions this forms a narrow strip of material between neighboring triangles that extends vertically at an angle (either angling forward as it extends upwards, or angling downward as it extends downwards).

The triangular openings of the upper row of triangular openings are centered or aligned with the triangular openings of the lower row. Because the bottom edge 188 of foregrip 180 is slightly longer than the top edge 186 the lower row of venting openings 198 includes an additional triangular opening both forward and rearward of the forward most triangular opening and rearward most triangular opening of the upper row of triangular openings, respectively.

The venting openings 198 of the foregrip 180 of each sidewall 196 are aligned with the venting openings 198 of the other sidewall 196. In this way, the pattern of venting openings 198 are minor images of one another on each of the sidewalls, or said another way the pattern is symmetric. While the pattern of triangular openings is shown and described herein, any other pattern of openings is hereby contemplated for use for venting and reducing the amount of material that foregrip 180 is formed of.

A plurality of mounting holes 200 are positioned in a row along the mid-line of foregrip 180. Mounting holes 200 extend through the material of the sidewalls 196 of foregrip 180 and are approximately centered on the flat portion of sidewalls 196. Mounting holes 200 are either threaded or non-threaded and are formed of any size, however in the arrangement shown a standard threaded hole is used, such as a ¼", 5⁄16", ⅜", 7⁄16", ½", 9⁄16", ⅝" or 4 mm, 5 mm, 6 mm, 7 mm, 8 mm, 9 mm, 10 mm or the like. This allows a conventional fastener, such as a screw or bolt to be used to attach additional components to the sidewalls 196 of foregrip 180 such as lasers, lights, optics, slings, or any other component. In one arrangement, mounting holes 200 are used to mount an additional rail, similar to top rail and bottom rail. This additional rail is then used to mount additional components thereto just as components are mounted to top rail 192 and bottom rail 194. Positioning the mounting holes 200 in the flat area of the sidewalls of foregrip 180 allows for a tight and strong and secure mounting place for such additional rails.

The plurality of mounting holes 200 are positioned in an equally spaced pattern to one another with each mounting hole 200 centered to each venting opening 198 both above and below the mounting hole 200. Additional mounting holes 200 may extend rearward and/or forward of the venting openings 198 for additional mounting capabilities.

A gas block opening 202 is positioned in a sidewall 196 of foregrip 180 adjacent the forward end 182. When foregrip 180 is installed onto firearm 10, gas block opening 202 provides access to the adjustable member 152 of the gas block 22. In this way, gas block opening 202 is sized and shaped to be approximately the diameter of the face of detent mechanism 154, or alternatively it is slightly larger than the face of detent mechanism 154 so as to also show reference mark 158. In this way, gas block opening 202 allows a user see the position of the adjustable member 152 as well as allowing a user to insert a screwdriver, Allen wrench, or other tool through foregrip 180 to engage and adjust the adjustable member 152. In the arrangement shown, gas block opening 202 is circular in shape. The pattern of triangular openings are modified so as to provide necessary room for gas block opening 202.

Dust Cover: A dust cover 22 is connected to receiver 12 after the components of the receiver are installed therein. Dust cover 22 is formed of any suitable size, shape and design. In the arrangement shown, dust cover 22 extends laterally from a forward end 204 to a rearward end 206, and vertically from a top edge 208 to a bottom edge 201.

A mounting tab 212 is positioned at the forward end 204 of dust cover 22 and includes an opening therein that extends from side-to-side horizontally through mounting tab 212. Mounting tab 212 is sized and shaped to be received between opposing arms 214 that extend upward from mounting bracket 216 which is connected to barrel 16 rearward of gas block 18 and forward of threaded end 104. Arms 214 include openings therein that align with the opening in mounting tab 212. Once aligned, a conventional fastener, such as a screw, bolt or pin or the like is inserted through mounting tab 212 and arms 214 thereby connecting the two components together while allowing dust cover 22 to pivot thereon and between arms 214 so as to provide quick and easy access to the internal components of receiver 12. In this way, the forward end 204 of dust cover 22 is pivotally secured to the firearm 10.

The rearward end 206 of dust cover 22 includes a rearward opening 218 that extends laterally, from side-to-side through dust cover 22. When dust cover 22 is installed onto receiver 12, the rearward opening 218 of dust cover 22 aligns with the mounting opening 81 in the stock mount 66. Once in this position, a conventional fastener, such as a screw, bolt or pin or the like is inserted through the rearward opening 218 and into mounting opening 81 thereby securing the rearward end 206 of dust cover 22.

The top edge 208 of dust cover 22 includes a top rail that extends the length of top edge 208 between mounting tab 212 and rearward opening 218. The top rail of dust cover 22 is similar, if not identical to the top rail 192 of foregrip 180 and when dust cover 22 is installed on receiver 12 the top rail of dust cover seamlessly aligns with the top rail 192 of foregrip 180. In this way, the top rail of the dust cover 22 and foregrip 180 allow for mounting of components across the length of the upper edge of firearm 10.

When dust cover 22 is installed onto receiver 12, the flat bottom edge 210 of dust cover 22 flushly aligns and engages the flat upper edge 64 of receiver 12. This close and tight if not engaging fit reduces the amount of contamination that can enter the open interior of receiver 12 thereby improving functioning of the firearm.

Quick Connect Sling Mount: Firearm 10 also includes a quick connect opening 220 in receiver 12. Quick connect opening 220 is sized and shaped to receive conventional single point sling mount connectors. The positioning of the quick connect opening 220 adjacent the rearward end 42 of receiver 12. Attaching a sling in this position provides for a sturdy mounting position and when a single point sling allows the firearm to hang in a safe and convenient downward angle when attached in this manner. A quick connect opening 220 is positioned in each outward facing sidewall 44 or receiver 12.

In Operation: The firearm 10 is assembled by inserting the trigger assembly 30 into the receiver 12 and installing the pistol grip 34 and butt stock 32 onto the receiver. Next the barrel 16 is threaded into the threaded bore 102 of trunnion 14 and pinned into place using locking pin 110 and the nut 114 is tightened against the trunnion 14 and is itself tightened in place using a pin or locking screw. Next the trunnion 14 is inserted into the forward end 40 of receiver 12 with the alignment features 86, 98 matingly engaging one another and pinching the forward end 118 of the extractor 116 between the receiver and the trunnion 14. The bottom tab 130 of the extractor 116 is screwed or bolted to the receiver 12. Once the trunnion 14 is fully inserted, the trunnion 14 is bolted in place using fasteners 112. Next the gas block 18 is installed over barrel 16 and pinned into place using locking pin 144 with the first gas bore 148 in fluid communication with the opening in the barrel 16 that allows a portion of the gas to travel through gas block 18 into gas tube 20. Once gas block 18 is installed, the adjustable member 152 is adjusted to allow the desired amount of gas to travel through first gas bore 148.

Once the gas block 18 is installed on barrel 16, the forward end of gas tube 20 is installed into the gas tube opening 146 and the rearward end is inserted between the opposing arms 214 of mounting bracket 216 thereby holding the rearward end of gas tube 20 in place. Next, the foregrip 180 is installed over the barrel 16. Once fully inserted over the barrel 16 the foregrip 180 is affixed to the barrel by passing conventional fasteners through mounting holes 200 and into aligned mounting holes in the gas block 18, mounting bracket 216, receiver 12 or any other component of the system 10.

Next the bolt carrier 24, bolt 26 and recoil spring 28 are installed into the receiver with the forward most end of bolt carrier 24 inserted into the gas tube 20 such that the end of the bolt carrier 24 is adjacent the gas block 18 such that exploding gas from barrel 16 engages the end of bolt carrier 24 after it passes through gas block 18 thereby forcing the bolt carrier 24 and bolt 26 rearward. Next, the dust cover 22 is installed over the receiver 12 using conventional fasteners through the mounting tab 212 and arms 214 of mounting bracket 216, as well as through the rearward opening 218 and into the mounting opening 81 in the stock mount 66 and thereby affixing the dust cover 22 to the system 10. Next, the magazine 36 is installed into the magazine well 60 and the bolt 26 dropped to close the action.

When the trigger 48 is pulled the exploding gasses travel down the bore of barrel 16. A portion of these gases pass through the opening of barrel 16 and into first gas bore 148 of gas block 18. These gasses are restricted by the positioning of adjustable member 152 in the first gas bore 148. The portion of gasses that are allowed to pass through the first gas bore 148 enter the gas tube opening 146, engage the forward end of bolt carrier 24 and force the bolt 26 and bolt carrier 24 rearward. After striking the forward end of bolt carrier 24, these gasses are at least partially vented through ports 164 in gas tube 20.

As the bolt 26 and bolt carrier 24 travel rearward they act in concert with the other components positioned within the receiver 12, including the extractor 116 to eject the spent casing and re-cock the hammer. Once the bolt carrier 24 and bolt 26 reach their rearward most position, the recoil spring 28 begins to force the bolt carrier 24 and bolt 26 forward again. As the bolt carrier 24 and bolt 26 travel forward they retrieve the next casing from magazine 36 and insert it into the bore of barrel 16, at which point the process can be repeated by again pulling the trigger 48.

Adjusting the adjustable member 152 of gas block 18 allows the user to quickly and easily adjust the force at which the bolt carrier 24 and bolt 26 travel rearward which allows a user to tune operation of the firearm 10 thereby making firearm 10 operate smoothly and eliminating "trigger slap" from the bolt carrier 24 and bolt 26 slamming too hard backward. This also allows a user to shoot many varieties of ammunition without affecting the operation of the firearm 10.

From the above discussion and the accompanying drawings and claims it will be appreciated that the improved semiautomatic firearm system presented offers many advantages over the prior art. That is, the semiautomatic firearm system presented combines the ruggedness of the AK-47 with the refined componentry and operation of the AR-15; is inexpensive to manufacture; can easily be modified; is accurate; is durable; has a refined look and feel and operation; is lightweight; can be easily disassembled and reassembled; allows for easy removal and replacement of components; provides adjustable operation; eliminates the "trigger slap" commonly found in AK-47 style firearms; is easy to use and familiar to those with knowledge and experience in the industry; has a long useful life; provides improved comfort and safety;

adopts many of the conventional components of the AR-15 and AK-47 firearms while utilizing new and improved components when and where applicable, among countless other improvements and advantages.

It will be appreciated by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in light thereof will be suggested to persons skilled in the art and are to be included within the spirit and purview of this application.

What is claimed is:

1. A semiautomatic firearm comprising:

a receiver having a rearward end and a forward end;

the receiver having opposing alignment features;

an action and a trigger assembly operably connected to the receiver;

a trunnion removably connected to the receiver;

the trunnion having a threaded bore, opposing alignment features, a locking pin opening and at least one fastener opening;

a barrel having a threaded end and a locking pin opening;

wherein the threaded end of the barrel is inserted into the threaded bore of the trunnion such that the locking pin opening in the barrel aligns with the locking pin opening in the trunnion;

wherein the trunnion is inserted into the forward end of the receiver such that the alignment features of the trunnion align with the alignment features of the receiver, a replaceable extractor, and wherein a portion of the extractor is pinched in place between the trunnion and the receiver.

2. The semiautomatic firearm of claim 1 further comprising a locking pin inserted into the locking pin opening of the trunnion and the locking pin opening in the barrel.

3. The semiautomatic firearm of claim 1 further comprising a replaceable extractor, wherein the extractor is screwed to the receiver.

4. The semiautomatic firearm of claim 1 further comprising a nut placed over the threaded end of the barrel and tightened against the trunnion.

5. The semiautomatic firearm of claim 1 further comprising at least one fastener extending through the receiver and into the trunnion thereby locking the trunnion in place.

* * * * *